US010212508B2

(12) United States Patent
Jeong et al.

(10) Patent No.: US 10,212,508 B2
(45) Date of Patent: Feb. 19, 2019

(54) ELECTRONIC DEVICE AND CURRENT CONSUMPTION CONTROL METHOD THEREOF

(71) Applicant: Samsung Electronics Co., Ltd., Gyeonggi-do (KR)

(72) Inventors: Eun-Su Jeong, Gyeonggi-do (KR); Yong-Yi Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/979,642

(22) Filed: May 15, 2018

(65) Prior Publication Data

US 2018/0338197 A1 Nov. 22, 2018

(30) Foreign Application Priority Data

May 19, 2017 (KR) ..... 10-2017-0062342

(51) Int. Cl.
*H04R 1/10* (2006.01)
*H04R 5/033* (2006.01)

(52) U.S. Cl.
CPC ..... *H04R 1/1041* (2013.01); *H04R 1/1025* (2013.01); *H04R 1/1033* (2013.01); *H04R 5/033* (2013.01); *H04R 2420/07* (2013.01); *H04R 2420/09* (2013.01)

(58) Field of Classification Search
CPC .. H04R 1/1025; H04R 1/1033; H04R 1/1041; H04R 5/033; H04R 2420/07; H04R 2420/09
See application file for complete search history.

(56) References Cited

U.S. PATENT DOCUMENTS

2012/0033824 A1 2/2012 Sim et al.
2015/0256010 A1 9/2015 Scandurra
2016/0240185 A1* 8/2016 Park ..... G10K 11/178
2017/0094389 A1 3/2017 Saulsbury et al.
2017/0134845 A1 5/2017 Milam et al.

FOREIGN PATENT DOCUMENTS

KR 10-2005-0111656 A 11/2005
KR 10-2016-0132575 A 11/2016

OTHER PUBLICATIONS

International Search Report dated Aug. 29, 2018.

* cited by examiner

*Primary Examiner* — Mark Fischer
(74) *Attorney, Agent, or Firm* — Cha & Reiter, LLC.

(57) ABSTRACT

Provided are an electronic device and a current consumption control method of the electronic device. More particularly, disclosed are an electronic device and a current consumption control method of the electronic device which couple a master electronic device and a slave electronic device by means of a cable, to decrease a current consumption amount. Provided are an electronic device and a current consumption control method of the electronic device which couple a master electronic device and a slave electronic device by means of a cable, to decrease current consumption amounts of the master electronic device and the slave electronic device and increase an operation time.

20 Claims, 7 Drawing Sheets

ELECTRONIC DEVICE AND CURRENT CONSUMPTION CONTROL METHOD THEREOF

CROSS-REFERENCE TO RELATED APPLICATION(S)

This application is based on and claims priority under 35 U.S.C. § 119 to Korean Patent Application No. 10-2017-0062342, filed on May 19, 2017, in the Korean Intellectual Property Office, the disclosure of which is incorporated by reference herein in its entirety.

BACKGROUND

Field

Various embodiments of the disclosure relate to an electronic device and a current consumption control method thereof and, more particularly, relate to an electronic device and a current consumption control method thereof, for wiredly coupling a pair of electronic devices possible to be wirelessly connected, to save a current consumption.

Description of Related Art

With the growth of technologies, a pair of electronic devices can provide not only output of audio data received from an operatively coupled external device (e.g., a smartphone, a tablet PC, etc.), a phone call, and/or transmission of control data controlling the external device, but also various services and functions through multitasking.

Among the pair of electronic devices (e.g., a first electronic device and a second electronic device), the first electronic device can wirelessly transmit part of audio data received from a wirelessly connected external device, to the paired second electronic device. Continuous power consumption occurs in the first electronic device wirelessly connected with the external device and transmitting to the second electronic device and the second electronic device wirelessly connected with the first electronic device.

The above information is presented as background information only to assist with an understanding of the present disclosure. No determination has been made, and no assertion is made, as to whether any of the above might be applicable as prior art with regard to the present disclosure.

SUMMARY

An electronic device according to an embodiment of the disclosure includes a wireless interface, a wired interface, an audio output unit configured to output audio data corresponding to one audio channel among audio data divided into a plurality of audio channels, and a processor electrically coupled to the wireless interface, the wired interface and the audio output unit. The processor is configured to identify a given signal by using the wired interface and, in response to the given signal being obtained, transmit audio data corresponding to another audio channel among the plurality of audio channels to another electronic device that is coupled using the wired interface.

According to an aspect of the disclosure, the processor may be set to, in response to being coupled with another electronic device by using the wireless interface, transmit the audio data corresponding to another audio channel to another electronic device by using the wireless interface.

An electronic device according to another embodiment of the disclosure includes a connector, an audio output unit, and a processor electrically coupled to the connector and the audio output unit, and the processor is configured to output audio data corresponding to one channel among stereo audio data through the audio output unit based on determination that the connector and a cable are coupled, and transmit audio data corresponding to another channel among the stereo audio data to another electronic device through the cable.

According to an aspect of the disclosure, the electronic device may be a master electronic device that operates in a master mode among master/slave modes, and another electronic device may be a slave electronic device that is in a sleep state of operating in a slave mode among the master/slave modes.

A current consumption control method of an electronic device according to an embodiment of the disclosure includes outputting audio data corresponding to one channel among stereo audio data from a master electronic device through an audio output unit, and wirelessly transmitting audio data corresponding to another channel among the stereo audio data from the master electronic device to a slave electronic device, determining that a cable and a connector of the master electronic device are coupled, sending a request for a change of the slave electronic device into a sleep state through the cable, based at least on the determination, and transmitting the audio data corresponding to another channel among the stereo audio data, to the slave electronic device changed into the sleep state through the cable during a given period of time (for example, continuously), and the cable includes a cable including a battery and a cable not including a battery.

According to an aspect of the disclosure, the method may further include, in response to a level of at least one battery among an internal battery of the master electronic device and an internal battery of the slave electronic device being insufficient, coupling with the cable including the battery, and charging the at least one battery among the internal battery of the master electronic device and the internal battery of the slave electronic device.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1A:
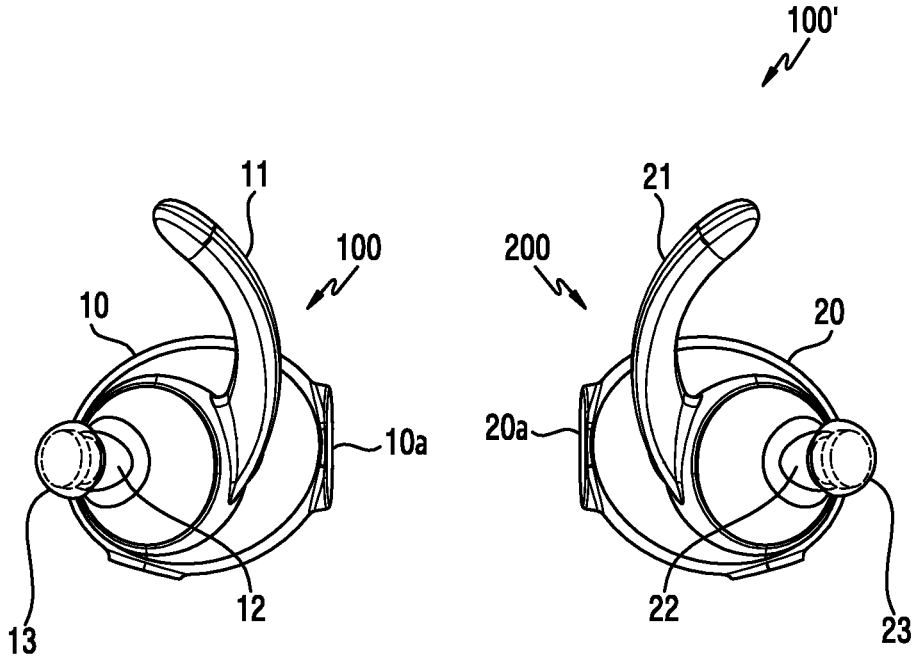
FIG. 1A, FIG. 1B and FIG. 1C are schematic diagrams illustrating an electronic device according to an embodiment of the disclosure.

Various embodiments of the document are mentioned below with reference to the accompanying drawings. It should be appreciated that an embodiment and the terms used therein are not intended to limit the technology set forth therein to a particular embodiment form, and include various modifications, equivalents, and/or alternatives of a corresponding embodiment. With regard to the description of the drawings, similar reference numerals may be used to refer to similar elements. The expression of a singular form may include the expression of a plural form unless otherwise dictating clearly in context.

In the document, the expression "A or B", "at least one of A and/or B" or the like may include all available combinations of words enumerated together. The expressions "a first", "a second", "the first", "the second", etc. may use corresponding constituent elements irrespective of order and/or importance, and are used to distinguish a constituent element from another without limiting the corresponding constituent element. In response to it being mentioned that any (e.g., first) constituent element is "(operatively or communicatively) coupled with/to" or "connected to" another (e.g., second) constituent element, the any constituent element may be directly coupled to another constituent element, or be coupled to another constituent element through a further constituent element (e.g., a third constituent element).

In the document, the expression "configured (or set) to~" may be used interchangeably with, for example, "suitable for~", "having the capacity to~", "adapted to~", "made to~", "capable of~" or "designed to~" in a hardware or software manner in accordance to circumstances. In some context, the expression "device configured to~" may represent that the device is "capable of~" together with other devices or components. For example, the phrase "processor configured (or set) to perform A, B, and C" may represent a dedicated processor (e.g., embedded processor) for performing a corresponding operation, or a generic-purpose processor (e.g., a central processing unit (CPU) or an application processor (AP)) capable of performing corresponding operations by executing one or more software programs stored in a memory device.

An electronic device according to various embodiments of the document may represent a pair of electronic devices which are operatively coupled and output an audio. The pair of electronic devices operatively mutually coupled may be implemented as a master electronic device which is worn on one ear among the left ear and the right ear and is available to output an audio, and a slave electronic device which is worn on the other ear and is available to output an audio. The pair of electronic devices operatively coupled through one of wired and wireless schemes may be implemented as a first electronic device which is worn on one ear among the left ear and the right ear and outputs an audio, and a second electronic device which is worn on the other ear and outputs an audio.

The pair of electronic devices operatively coupled through one of the wired and wireless schemes may be implemented as a first earbud which is worn on one ear among the left ear and the right ear and outputs an audio, and a second earbud which is worn on the other ear and outputs an audio. Also, the pair of electronic devices operatively coupled through one of the wired and wireless schemes may be implemented as a master earbud which is worn on one ear among the left ear and the right ear and outputs an audio, and a slave earbud which is worn on the other ear and outputs an audio.

The pair of electronic devices operatively coupled through the wired and wireless schemes may include a portable audio apparatus. The portable audio apparatus may include a headphone, headset, or earphone which may output an audio to the both ears.

The external device operatively coupled with the pair of electronic devices, capable of transmitting audio data to the pair of electronic devices, may be sufficient. The external device operatively coupled with the pair of electronic devices, capable of transmitting audio data to one electronic device among the pair of electronic devices, may be sufficient. For example, the external device may include at least one of a smartphone, a tablet personal computer (PC), a mobile phone, a video phone, an electronic book reader, a desktop PC, a laptop PC, a netbook computer, a workstation, a server, a portable digital assistant (PDA), a portable multimedia player (PMP), an MPEG-1 audio layer-3 (MP3) player, a medical device, a camera, or a wearable device.

The wearable device may include at least one of an accessory type (e.g., a watch, a ring, a wristlet, an anklet, a necklace, glasses, contact lens, or head-mounted-device (HMD)), fabric or clothing integral type (e.g., electronic clothes), human-body mount type (e.g., skin pad or tattoo), or bio implantation type circuit.

In some exemplary embodiments, the external device may include at least one of a television, a digital video disk (DVD) player, an audio system, a refrigerator, an air conditioner, a cleaner, an oven, a microwave, a washing machine, an air cleaner, a set-top box, a home automation control panel, a security control panel, a media box (e.g., Samsung HomeSync™, Apple TV™, or Google TV™), a game console (e.g., Xbox™ or PlayStation™), an electronic dictionary, an electronic locking system, a camcorder, or an electronic frame.

In another embodiment, the external device may include at least one of various medical devices (e.g., various portable medical measurement devices (i.e., a blood glucose sensor, a heat rate sensor, a blood pressure monitor, a body temperature meter or the like), magnetic resonance angiography (MRA), magnetic resonance imaging (MRI), computed tomography (CT), a photographing machine, an ultrasonic machine or the like), a navigation device, a global navigation satellite system (GNSS), an event data recorder (EDR), a flight data recorder (FDR), a car infotainment device, an electronic equipment for ship (e.g., a navigation device for ship, a gyrocompass, etc.), avionics, a security device, a head unit for car, an industrial or home robot, a drone, an automatic teller's machine (ATM) of a financial institution, a point of sales (POS) of a shop, or an Internet of Things (IoT) device (e.g., an electric bulb, various sensors, a sprinkler device, a fire alarm, a thermostat, a streetlight, a toaster, an exerciser, a hot water tank, a heater, a boiler, etc.).

According to some exemplary embodiment, the external device may include at least one of a part of furniture, building/structure or car, an electronic board, an electronic signature receiving device, a projector, or various metering devices (e.g., tap water, electricity, gas, radio wave metering devices or the like). In various embodiments, the external device may be flexible, or be a combination of two or more of the aforementioned various devices. The electronic device according to an embodiment of the document is not limited to the aforementioned devices. In the document, the term 'user' may denote a person who uses the electronic device or a device (e.g., artificial-intelligent electronic device) which uses the electronic device.

An application according to various embodiments of the disclosure represents an operating system (OS) for computer, or software run on a mobile OS and used by a user. For example, the application may include a web browser, a camera application, a mobile payment application (or an electronic payment application and/or a payment application), a photo album application, a word processor, a spread sheet, a contacts application, a calendar application, a memo application, an alarm application, a social network system (SNS) application, a call application, a game store, a game application, a chatting application, a map application, a music player, a video player or the like.

The application according to various embodiments of the disclosure may represent software which is run in an electronic device or an external device (e.g., a wearable device, a server, etc.) wirelessly or wiredly coupled with the electronic device. Also, the application according to various embodiments of the disclosure may represent software which is run in the electronic device correspondingly to a received user input.

Content may be executed or displayed through a corresponding executed application. For example, the content may include a video file or audio file played in a video player that is one of applications, a game file executed in a game application, a music file played in a music player, a photo file displayed in a photo album application, a webpage file displayed in a web browser, payment information (e.g., a mobile card number, a payment money, a goods name, a service name, a store name or the like) displayed in an electronic payment application or the like. Also, the content may include a call screen (e.g., including a caller phone number (i.e., a caller ID), a caller name, a call start time, a caller video (or caller image) by a video call or the like) displayed in a call application.

The content may include an executed application screen and a user interface configuring the application screen. Also, the content may include one content or a plurality of contents as well.

A widget represents a mini application that is one of graphic user interfaces (GUI) more smoothly supporting interaction with a user and an application or OS. For example, there are a weather widget, a calculator widget, a clock widget, etc.

In various embodiments of the disclosure, a "user input" may be, for example, used as the term including user's button (key) selection, user's button (or key) pressing (or clicking), user's soft button (or soft key) touch, a user's touch (or including a non-contact such as hovering) received (or obtained) on a touch screen, a user's touch gesture (or including a non-contact such as hovering) received (or obtained) on the touch screen, a user's voice, user's presence (e.g., user's appearing within a camera recognition range), or a user's motion. Also, "button (or key) selection" may be used as the term representing button (or key) pressing (clicking) or soft button (soft key) touch.

The term used herein is used to explain various embodiments, and is not intended to restrict and/or limit the disclosure. The expression of a singular form may include the expression of a plural form unless otherwise dictating clearly in context. Also, in the specification, it should be understood that the term "comprise", "have", or the like intends to designate the existence of features, numerals, steps, operations, constituent elements, components or a combination of them mentioned in the specification, and do not previously exclude the possibility of existence or addition of one or more other features, numerals, steps, operations, constituent elements, components or combinations of them. The same reference numeral presented in each figure represents a member performing the substantially same function.

Figure 1B:
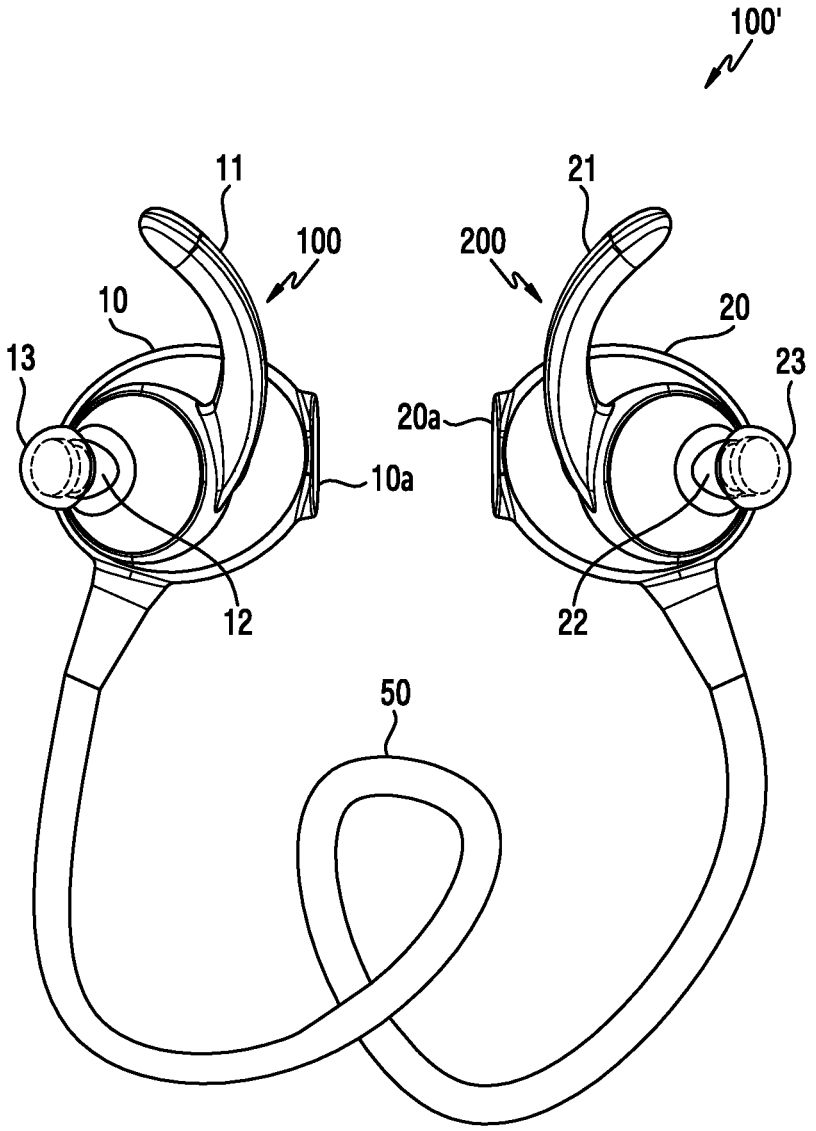
Figure 1C:
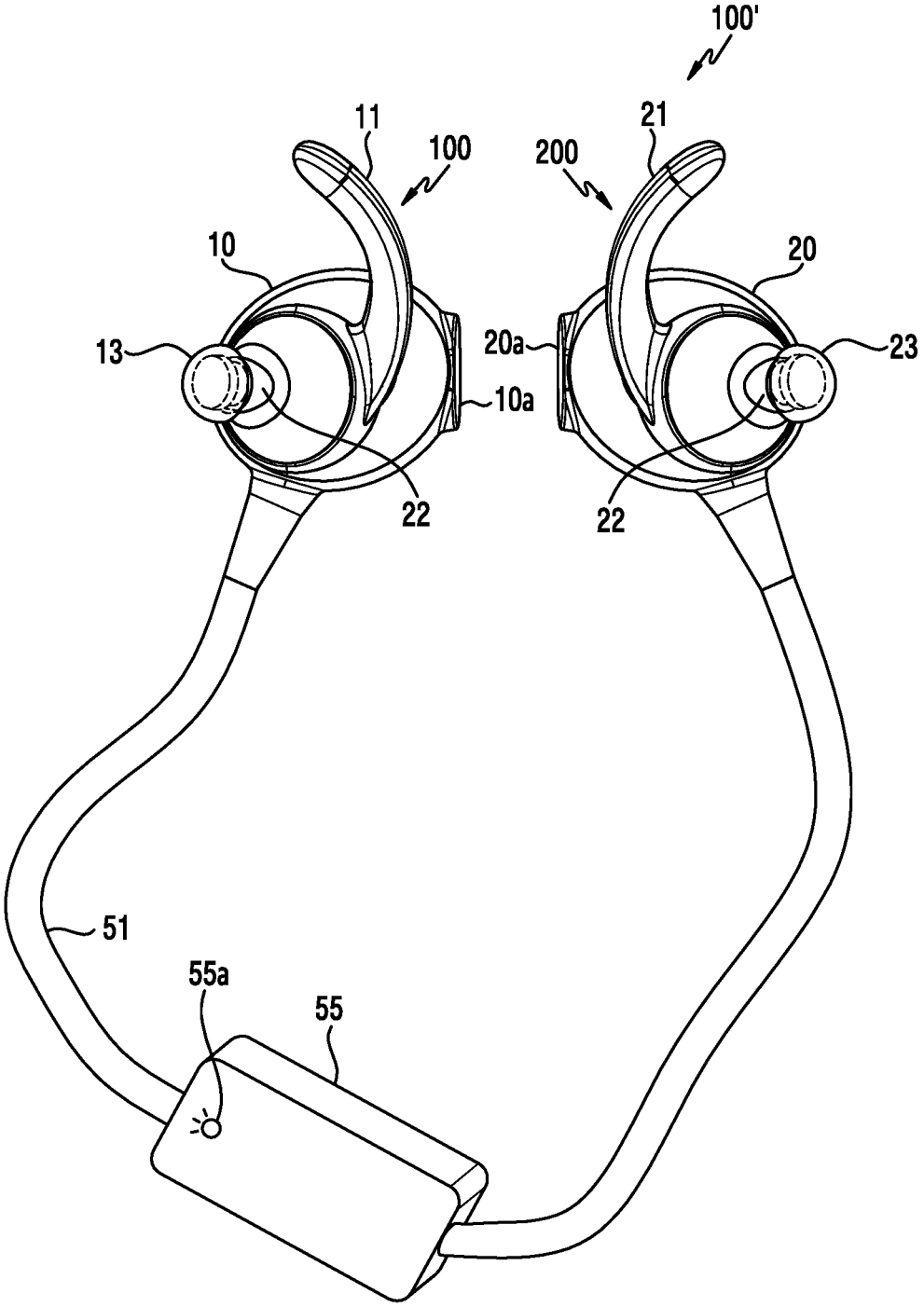

FIG. 1A to FIG. 1C are schematic diagrams illustrating an electronic device according to various embodiments of the disclosure.

Referring to FIG. 1A to FIG. 1C, a pair of electronic devices 100' including a first electronic device 100 and a second electronic device 200 which are wearable on both ears of a user are illustrated. In certain embodiments, one of the electronic devices, e.g., electronic device 100, determines whether it is connected to another electronic device 200. Based on whether they are connected, the electronic device 100 can either receive audio data and output audio data in mono, or play one channel of the audio data, and provide another channel (for example, two stereo channels) to the other electronic device 200.

The pair of electronic devices 100' may include a portable audio apparatus which is operatively coupled through one of wired and wireless schemes and outputs audio data. In FIG. 1A, the pair of electronic devices 100' wearable on the both ears of the user are not coupled through a cable 50 illustrated in FIG. 1B. In FIG. 1B, the pair of electronic devices 100' wearable on the both ears of the user may be coupled mutually by means of the cable 50. In FIG. 1C, the pair of electronic devices 100' wearable on the both ears of the user may be coupled mutually by means of a cable 51 including an external battery 55.

Referring to FIG. 1A, among the pair of electronic devices 100', the first electronic device 100 worn on either ear (e.g., the left ear) and outputting audio data may include a housing 10 forming an appearance or exterior of the first electronic device 100 and a circuit substrate (not shown) positioned within the housing 10. An earfin 11 may be combined to the housing 10. An ear tip 13 may be mounted on a protrusion part (or nozzle) 12 extended from the housing 10. An internal path (not shown) of the protrusion part 12 may be a path of audio data which is outputted from an audio output unit 160 (seeing FIG. 2) positioned within the housing 10.

The housing 10, 20 may be implemented using materials having rigidity (e.g., having the rigidity of polystyrene or polymer materials) which is possible to protect constituent elements (e.g., 110 to 195 illustrated in FIG. 2) inside the housing 10. Part of the materials of the housing 10 may include metal, glass, leather or lumber. An external surface of the housing 10 may be coated with polyurethane. Also, the external surface of the housing 10 may be subjected to waterproof coating (or waterproof film) processing resistant to a moisture including a user's sweat or a rain as well. Materials of the protrusion part 12 extended from the housing 10 may be substantially similar with the materials of the housing 10.

The ear tip 13, 23 mounted on the protrusion part 12, 22 may be inserted into the external auditory meatus (or ear hole) of a user. Also, even a part of the protrusion part 12, 22 coupled with the ear tip 13, 23 may be inserted into the external auditory meatus of the user. Interchangeable ear tips 13, 23 each having a different diameter according to a diameter of the external auditory meatus of the user may be coupled with the protrusion part 12, 22. The ear tip 13, 23 which is of materials having elasticity (e.g., silicon, polyurethane or the like), may be inserted into the external auditory meatus of the user.

Figure 2:
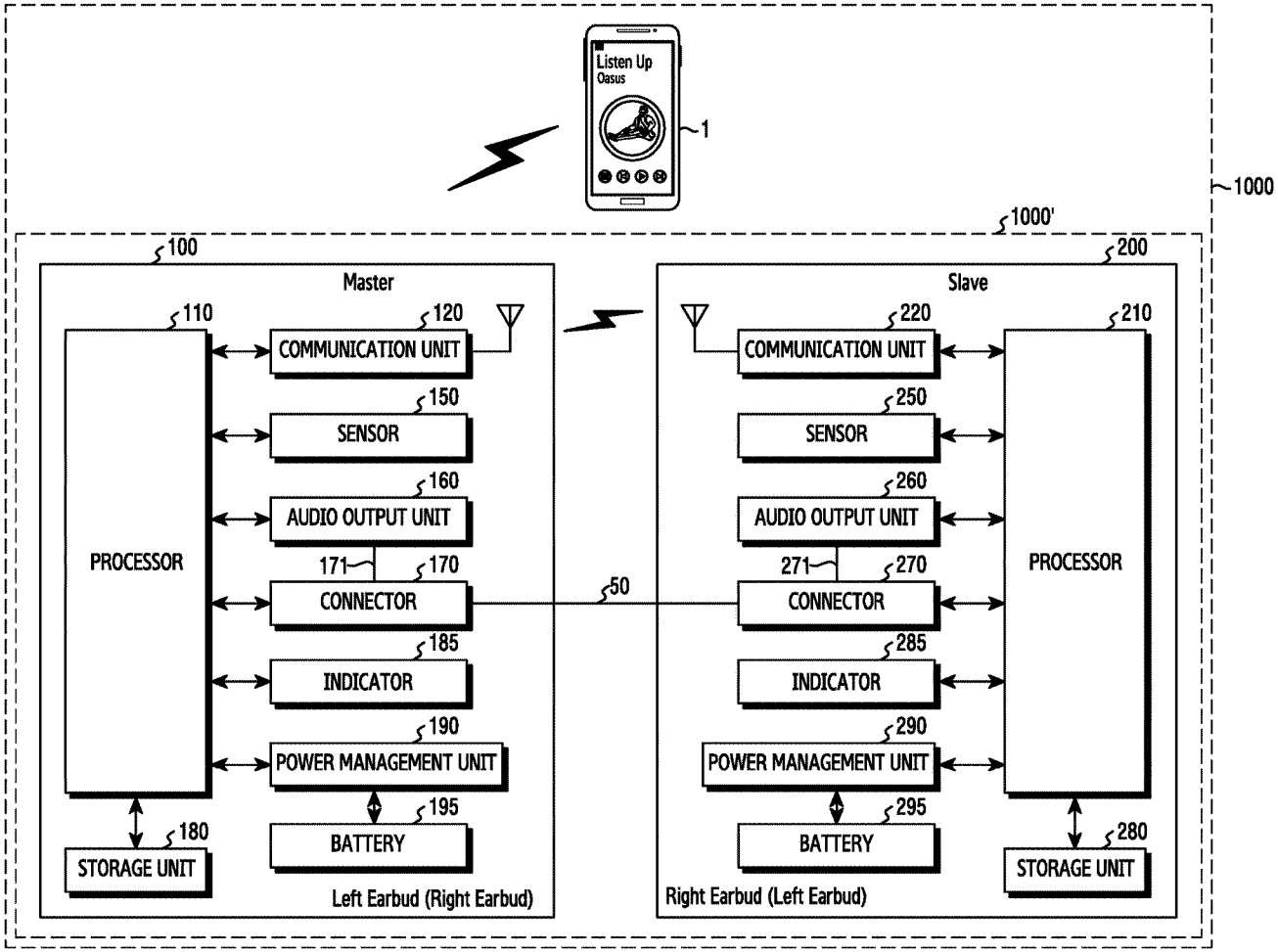
FIG. 2 is a schematic block diagram illustrating an electronic device according to an embodiment of the disclosure.

Audio data output from the audio output unit 160, 260 illustrated in FIG. 2 may be forwarded to the eardrum of the user via the inside of the housing 10, 20 an internal path of the protrusion part 12, 22 and the ear tip 13, 23.

Among the pair of electronic devices 100', the second electronic device 200 worn on the other ear (e.g., the right ear) among the left ear and the right ear and outputting audio data may include a housing 20 forming an appearance of the second electronic device 200, and a circuit substrate (not shown) positioned within the housing 20. An ear tip 23 may be mounted on a protrusion part 22 extended from the housing 20. An internal path (not shown) of the protrusion part 22 may be a path of audio data which is outputted from an audio output unit 260 (seeing FIG. 2) positioned within the housing 20.

A first magnet (e.g., the N pole) may be positioned inside one side 10*a* of the first electronic device 100. A second magnet (e.g., the S pole) may be positioned inside one side 20*a*; of the second electronic device 200 facing the one side 10*a* of the first electronic device 100. The one side 10*a* of the first electronic device 100 and the one side 20*a* of the second electronic device 100 may be combined by means of the magnets (not shown).

Referring to FIG. 1B, the pair of electronic devices 100' wearable on the both ears of the user is coupled mutually by means of the cable 50. One end (e.g., a first connector) of the cable 50 may be coupled with a connector (e.g., a connector 170 illustrated in FIG. 2 or a port) of the first electronic device 100. Also, the other end (e.g., a second connector) of the cable 50 may be coupled with a connector (e.g., a connector 270 illustrated in FIG. 2 or a port) of the second electronic device 200.

In response to the cable 50 being coupled, a master electronic device (e.g., the first electronic device 100) among the pair of electronic devices 100' may transmit partial (e.g., one channel among multi-channel sounds) audio data among stereo audio data, to a slave electronic device (e.g., the second electronic device 200) via the cable 50. According to various embodiments, the master electronic device 100 may transmit audio data (e.g., a mono (one-channel) signal) received from an external device 1 illustrated in FIG. 2 or FIG. 3, to the slave electronic device 200 via the cable 50. In response to the cable 50 being coupled mutually with the pair of electronic devices 100', the master electronic device 100 (changeable into 200) among the pair of electronic devices 100' may transmit the partial (e.g., one channel among multi-channel sounds) audio data, to the slave electronic device 200 (changeable into 100) via the cable 50 by using a switch (not shown) (being implemented by at least one of hardware, firmware and software or a combination thereof).

The transmission of the partial (e.g., one channel among multi-channel sounds) audio data among the stereo audio data via the cable 50 may reduce a current consumption of the slave electronic device. A detailed description for the cable 50 is made later.

Referring to FIG. 1C, the pair of electronic devices 100' wearable on the both ears of the user are coupled by means of a cable 51 including an external battery 55. One end (e.g., an eleventh connector) of the cable 51 including the external battery 55 may be coupled with the connector (e.g., the connector 170 illustrated in FIG. 2 or the port) of the first electronic device 100. Also, the other end (e.g., a twelfth connector) of the cable 51 including the external battery 55 may be coupled with the connector (e.g., the connector 270 illustrated in FIG. 2 or the port) of the second electronic device 200.

In response to the cable 51 including the external battery 55 being coupled, batteries (e.g., 195 or 295 illustrated in FIG. 2) of the pair of electronic devices 100' may be charged by the external battery 55, respectively.

In response to the cable 51 including the external battery 55 being coupled, a master electronic device (e.g., the first electronic device 100) among the pair of electronic devices 100' may transmit partial (e.g., one channel among multi-channel sounds) audio data among stereo audio data to a slave electronic device (e.g., the second electronic device 200) via the cable 51 including the external battery 55. In response to the cable 51 including the external battery 55 being coupled mutually with the pair of electronic devices 100', the master electronic device (e.g., the first electronic device 100) among the pair of electronic devices 100' may transmit the partial (e.g., one channel among multi-channel sounds) audio data among the stereo audio data to the slave electronic device (e.g., the second electronic device 200) via the cable 51, by using a switch (not shown) (being implemented by at least one of hardware, or hardware programmed with software).

The transmission of the partial (e.g., one channel among a plurality of channel sounds) audio data among the stereo audio data via the cable 51 including the external battery 55 may reduce a current consumption of the slave electronic device 200. A detailed description for the cable 51 including the external battery 55 is made later.

FIG. 2 is a schematic block diagram illustrating an electronic device according to an embodiment of the disclosure.

Referring to FIG. 1A, FIG. 1B and FIG. 2, the pair of electronic devices 100' may be mutually operatively coupled using communication units 120 and 220 (1000') (for example, it may mean that the pair of electronic devices may be mutually wirelessly coupled using one of a plurality of Bluetooth profiles). The aforementioned 'operatively coupled' may mean that a first constituent element (e.g., a first electronic device) is directly coupled to another second constituent element (e.g., a second electronic device), or is coupled via another third constituent element (e.g., an access point (AP), etc.).

One electronic device among the pair of electronic devices 100' may be operatively coupled with the external device 1 by using a communication unit. The one electronic device (e.g., the first electronic device 100) coupled with the external device 1 and the other electronic device (e.g., the second electronic device 200) may be coupled (1000) operatively mutually.

An electronic device that is operatively coupled wiredly or wirelessly with the external device 1 and receives audio data and transmits part of the received audio data to another electronic device is described as a master electronic device. Another electronic device operatively coupled by wire or wirelessly with the master electronic device is described as a slave electronic device. In an embodiment of the disclosure, the electronic device may represent the pair of electronic devices 100' or an individual electronic device (e.g., the first electronic device 100 or the second electronic device 200).

The first electronic device 100 operable as the master electronic device among the pair of electronic devices 100' may include a processor 110, a communication unit 120, a sensor 150, the audio output unit 160, a connector 170, a storage unit 180, an indicator 185, a power management unit 190, and a battery 195.

By driving an operating system (OS) or an application program, the processor 110 may control a majority of hardware or software constituent elements coupled to the processor 110, and may perform various data processing and operations. The processor 110 may be, for example, implemented as a System On Chip (SoC). The processor 110 may load a command or data received from at least one of the other constituent elements (e.g., non-volatile memory), to a volatile memory, and process the loaded command or data, and store various data in the non-volatile memory.

The communication unit 120 may connect the first electronic device 100 and another electronic device 200, or the electronic device 100 and the external device 1 through at least one of a wired communication and a wireless communication. The communication unit 120 may be used as a wireless interface for wirelessly coupling with another electronic device (e.g., the second electronic device 200) or the external device 1.

The communication unit 120 may wirelessly receive stereo audio data from the external device 1. The communication unit 120 may wirelessly transmit audio data corresponding to one channel among the received stereo audio data, to the second electronic device 200. Among the stereo audio data received through the communication unit 120, the audio data corresponding to the one channel may be transmitted to another electronic device 200 through a wire (or cable).

The wireless communication may include a cellular communication and/or a short-range communication. The short-range communication may, for example, include at least one of wireless fidelity (WiFi), light fidelity (Li-Fi), Bluetooth (or Bluetooth low energy), near field communication (NFC), a global navigation satellite system (GNSS) (or including a global positioning system (GPS)) or the like. The wired communication may, for example, include at least one of a universal serial bus (USB), a high definition multimedia interface (HDMI), recommended standard-232 (RS-232), a plain old telephone service (POTS) or the like.

The sensor 150 may measure a physical quantity (or an external physical quantity) of the inside of the first electronic device 100 or sense an activation state of the first electronic device 201, and convert measured or sensed information into an electric signal. The sensor 150 may, for example, include at least one of a gyro sensor, a barometer, an acceleration sensor, a proximity sensor, a medical sensor, and an illuminance sensor. The medical sensor may include an electromyography (EMG) sensor, an electroencephalogram (EEG) sensor, or an electrocardiogram (ECG) sensor. The aforementioned sensor 150 is one example, and may be added, changed or excluded according to a structure and/or function of the first electronic device 100.

The audio output unit 160 may output a sound corresponding to audio data that is received (or stored) under the control of the processor 110. The audio output unit 160 may output audio data corresponding to one channel among stereo audio data that is received (or stored) under the control of the processor 110. The audio output unit 160 may include a speaker, for example.

The received (or stored) audio data may be decoded by an audio codec (not shown) (being implemented by at least one of hardware, or hardware programmed with software (or a combination thereof)) under the control of the processor 110 and be outputted as a sound through the audio output unit 160.

In response to the cable 50 not being coupled to the connector 170, the processor 110 may control to output, through the audio output unit 160, a sound corresponding to audio data received through the communication unit 120. In certain embodiments, the processor 110 may cause the audio output unit 160 (e.g., speaker) to provide the audio output in mono.

The connector 170 may be used as at least a part of an interface (or a wired interface) for coupling the first electronic device 100 and the second electronic device 200, or the first electronic device 100 and the external device 1. The cable 50 (e.g., being implemented as a part of a USB cable or being implemented as a part of a 3.5 mm stereo audio cable) may be coupled to the connector 170.

The aforementioned cable 50 coupled to the connector 170 is one example, and a cable possible to transmit audio data from a master electronic device (e.g., the first electronic device 100) to a slave electronic device (e.g., the second electronic device 200) may be sufficient.

The processor 110 may determine that the connector 170 and the cable 50 are coupled using a cable coupling determination pin (cable_det pin). The cable coupling pin is configured to have different values based on whether the connector 170 and the cable 50 are connected.

The cable 50 may forward audio data corresponding to one channel among stereo audio data, from the master electronic device 100 among the pair of electronic devices 100' to the slave electronic device 200. The cable 50 may comprise of a plurality of wires. Both ends (e.g., connectors or plugs) of the cable 50 may include a plurality of pins corresponding to the plurality of wires.

In response to the cable 50 being coupled to the connector 170, the processor 110 may control to output a sound corresponding to received (or stored) audio data through each of the audio output unit 160 and the cable 50 by using a switch (not shown) (being implemented by at least one of hardware, firmware and software (or a combination thereof)).

In response to the cable 50 being coupled to the connector 170, the processor 110 may control to differently output the sound corresponding to the received (or stored) audio data through the audio output unit 160 and the cable 50, by using the switch (not shown). For example, in response to audio data corresponding to one channel among stereo audio data being outputted to the audio output unit 160 by using the switch (not shown) under the control of the processor 110, the processor 110 may output audio data corresponding to a remaining (or another) channel among the stereo audio data through the cable 50 by using the switch (not shown).

The plurality of wires configuring the cable 50 may be implemented as a first wire corresponding to a cable coupling determination pin (cable_det pin), a second wire corresponding to a communication pin for communication (e.g., operation information (i.e., play, pause, etc.) transmission, state information (i.e., a data reception error, etc.) transmission, or the like) between the respective electronic devices 100 and 200, a third wire corresponding to right-out (Rout) to which audio data corresponding to one channel among stereo audio data is forwarded, a fourth wire corresponding to left-out (Lout) to which audio data corresponding to another channel among the stereo audio data is forwarded, and a fifth wire corresponding to a ground pin (GND pin).

Correspondingly to the identified master electronic device, audio data corresponding to one channel among stereo audio data may be forwarded to the slave electronic device through one of the third wire corresponding to the right-out (Rout) within the cable 50 and the fourth wire corresponding to the left-out (Lout). For example, in response to the electronic device 100 being a master electronic device, the audio data corresponding to the one channel among the stereo audio data may be transmitted to the slave electronic device 200 through the third wire corresponding to the right-out (Rout) within the cable 50 coupled to the connector 170. In response to the electronic device 200 being a master electronic device, the audio data corresponding to the one channel among the stereo audio data may be forwarded to the slave electronic device 100 through the fourth wire corresponding to the left-out (Lout) in the cable 50 coupled to the connector 170.

According to various embodiments, the cable 50 may include at least one or more of the first wire corresponding to the coupling determination pin (cable_det pin), the second wire corresponding to the communication pin for communication (e.g., state information exchange of the two devices) between the electronic devices 100 and 200, the third wire for transmitting at least one (e.g., one of the right-out (Rout) and the left-out (Lout)) audio channel signal, and the fourth wire corresponding to the ground pin.

According to various embodiments, in response to the cable 50 being a standard USB cable, the cable 50 may set operations of the electronic devices 100 and 200 through identification (ID) checking. For example, the cable 50 may set which one of the pair of electronic devices is a master electronic device. The cable 50 may perform switching corresponding to the master electronic device and the slave electronic device.

According to various embodiments, in response to the cable 50 being a USB type C cable, the cable 50 may set operations of the electronic devices 100 and 200 by a configuration channel. For example, the cable 50 may set which one of the pair of electronic devices is a master electronic device as well.

The storage unit 180 may store a command or data related with at least one constituent element (e.g., 120 to 195) of the first electronic device 100. The storage unit 180 may store software and/or program. The program may, for example, include a kernel, a middleware, an application programming interface (API), an application program (or "application") 147 and/or the like. At least some of the kernel, the middleware or the API may be called an operating system (OS).

The storage unit 180 may, for example, include at least one of a volatile memory (e.g., a dynamic random access memory (DRAM), a static RAM (SRAM), a synchronous dynamic RAM (SDRAM) or the like), a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a Not AND (NAND) flash, a Not OR (NOR) flash or the like), a hard drive, or a solid state drive (SSD).

The indicator 185 may display operation information (e.g., play, pause, charge, etc.) of the electronic device 100 and/or state information (e.g., booting, data reception, in-charge, battery level shortage, etc.) by flicker or color change. The indicator 185 may include one or more LEDs, for example.

The power management unit 190 may manage a current of the electronic device 100 supplied from the battery 195. The power management unit 190 may include a power management integrated circuit (PMIC) or a charger integrated circuit (IC). The PMIC may, for example, have a wired charging scheme and/or a wireless charging scheme. The wireless charging scheme may include a magnetic resonance scheme, a magnetic induction scheme, an electromagnetic wave scheme, or the like. The wireless charging scheme may further include a supplementary circuit (e.g., a coil loop, a resonance circuit, a rectifier or the like) for wireless charging.

The second electronic device 200 operable as the slave electronic device among the pair of electronic devices 100' may include a processor 210, a communication unit 220, a sensor 250, the audio output unit 260, a connector 270, a storage unit 280, an indicator 285, a power management unit 290, and a battery 295.

The constituent elements 210 to 295 of the slave electronic device (e.g., the second electronic device 200) are substantially similar with the aforementioned constituent elements 110 to 195 of the master electronic device (e.g., the first electronic device 100) and thus, a duplicated description thereof is omitted.

In response to the first electronic device 100 worn on the left ear among the pair of electronic devices 100' being a master electronic device, the second electronic device 200 worn on the right ear may be a slave electronic device. Also, in response to the second electronic device 200 worn on the right ear among the pair of electronic devices 100' being a master electronic device, the first electronic device 100 worn on the left ear may be a slave electronic device.

Among the pair of electronic devices 100' mutually coupled by the cable 50, the master electronic device may transmit (or output) audio data corresponding to one channel among stereo audio data received from the external (or stored in the storage unit), to the slave electronic device through the cable 50. Among the pair of electronic devices 100', the master electronic device may transmit (or output) the audio data corresponding to the one channel among the received (or stored) stereo audio data, to the slave electronic device through one of the Lout and the Rout of the cable 50.

Figure 3:
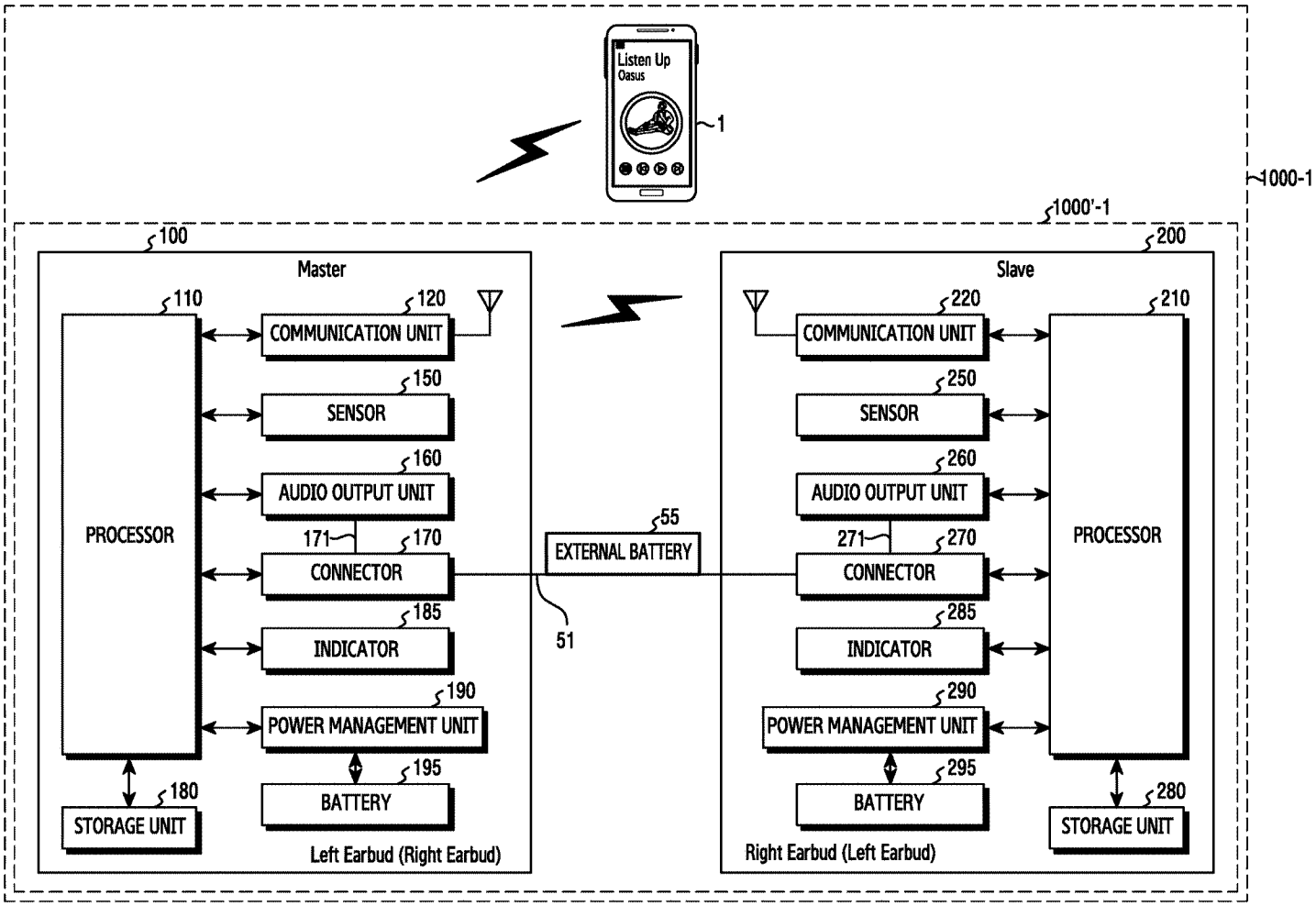
FIG. 3 is a schematic block diagram illustrating an electronic device according to another embodiment of the disclosure.

FIG. 3 is a schematic block diagram illustrating an electronic device according to another embodiment of the disclosure.

Referring to FIG. 1C and FIG. 3, the pair of electronic devices 100' may be mutually operatively coupled (1000'-1) by using the communication units 120 and 220. Among the pair of electronic devices 100', one electronic device (e.g., the first electronic device 100) may be operatively coupled with the external device 1 by using the communication unit 120. The one electronic device 100 coupled with the external device 1 may be operatively coupled (1000-1) with another electronic device (e.g., the second electronic device 200).

The first electronic device 100 operable as the master electronic device among the pair of electronic devices 100' may include a processor 110, a communication unit 120, a sensor 150, an audio output unit 160, a connector 170, a storage unit 180, an indicator 185, a power management unit 190, and a battery 195.

The constituent elements 110 to 195 of the master electronic device 100 of FIG. 3 are substantially similar with the constituent elements 110 to 195 of the master electronic device 100 of FIG. 2 and thus, a duplicated description thereof is omitted.

The connector 170 may be used as an interface (or a wired interface) for coupling the first electronic device 100 and the second electronic device 200, or the electronic device 100 and the external device 1, or the electronic device 100 and an external battery 55. A cable 51 (e.g., being implemented as a part of a USB cable or being implemented as a part of a 3.5 mm stereo audio cable) may be coupled to the connector 170.

The aforementioned cable 51 coupled to the connector 170 is one example, and a cable with the external battery 55 possible to transmit audio data to the slave electronic device 200, a cable possible to charge the battery 195 through the external battery 55, or a cable possible to transmit audio data to the slave electronic device 200 and charge the battery 195 through the external battery 55 may be sufficient.

The processor 110 may determine that the connector 170 is coupled to a cable 51 including the external battery 55 by using a cable coupling determination pin (cable_det pin).

According to various embodiments, the processor 110 may determine that another electronic device (e.g., the slave electronic device or the second electronic device) is coupled with the connector 170 by a cable coupling detection line (cable_det line) or a coupling configuration communication line (configuration line). In response to a cable being the cable 51 including the external battery 55, the processor 110 may obtain a voltage (Vbus line) of a power line, to identify charging or non-charging.

The cable 51 including the external battery 55 is substantially similar with the battery 50 of FIG. 2 (e.g., it may be partially different in battery existence or non-existence, wire count difference and the like) and thus, a duplicated description thereof is omitted.

The cable 51 including the external battery 55 may charge each of the internal batteries 195 and 295 of the pair of coupled electronic devices 100'. The cable 51 including the external battery 55 may forward audio data corresponding to one channel among stereo audio data, from the master electronic device 100 among the pair of coupled electronic devices 100' to the slave electronic device 200. The cable 51 including the external battery 55 may comprise a plurality of wires. The number of wires configuring the cable 51 including the external battery 55 may be different from the number of wires configuring the cable 50 not including the external battery 55. The number of wires with the cable 51 including the external battery 55 may be greater than the number of wires of the cable 50 not including the external battery 55. In certain embodiments, the connector 170 and processor 110 may determine whether a cable coupled to the connector 170 has an external battery by the number of pins that are contact in the connector 170 by the cable.

Both ends (e.g., connectors or plugs) of the cable 51 including the external battery 55 may include a plurality of pins corresponding to the plurality of wires. The number of pins configuring the cable 51 including the external battery 55 may be different from the number of pins configuring the cable 50 not including the external battery 55. The number of pins configuring the cable 51 including the external battery 55 may be greater than the number of pins configuring the cable 50 not including the external battery 55.

In response to the cable 51 including the external battery 55 being coupled to the connector 170, the processor 110 may control to output a sound corresponding to received (or stored) audio data through each of the audio output unit 160 and the cable 51 including the external battery 55 by using a switch (not shown) (being implemented by at least one of hardware, or hardware programmed with software).

In response to the cable 51 including the external battery 55 being coupled to the connector 170, the processor 110 output the sound corresponding to the received (or stored) audio data differently through the audio output unit 160 and the cable 50 by using the switch (not shown). For example, in response to audio data corresponding to one channel among stereo audio data being outputted to the audio output unit 160 by using the switch (not shown) under the control of the processor 110, the processor 110 may output audio data corresponding to a remaining (or another) channel among the stereo audio data through the cable 51 including the external battery 55 coupled to the connector 170, by using the switch (not shown).

A plurality of wires configuring the cable 51 including the external battery 55 may be implemented as a first wire corresponding to a cable coupling determination pin, a second wire corresponding to a communication pin for communication (e.g., operation information (i.e., play, pause, charge, etc.) transmission, state information (i.e., data reception error, battery level shortage, etc.) transmission or the like) between the respective electronic devices 100 and 200, a third wire corresponding to right-out (Rout) to which audio data corresponding to one channel among stereo audio data is forwarded, a fourth wire corresponding to left-out (Lout) to which audio data corresponding to another channel among the stereo audio data is forwarded, a fifth wire corresponding to a ground pin (GND pin), and a sixth wire corresponding to a plus (+) wire, and a seventh wire corresponding to a minus (−) battery.

According to various embodiments, the cable 51 may include at least one or more of the first wire corresponding to the coupling determination pin (cable_det pin), the second wire corresponding to the communication pin for communication between the electronic devices 100 and 200 (e.g., state information exchange of the two devices), the third wire for transmitting at least one (e.g., one of the right-out (Rout) and the left-out (Lout)) audio channel signal, the fourth wire corresponding to the ground pin, the fifth wire corresponding to the plus (+) wire, and the sixth wire corresponding to the minus (−) battery. In various embodiments, the wire corresponding to the ground pin in the cable 51 may use the wire corresponding to the minus (−) battery for common use. In this case, a total number of wires of the cable 51 may be five (e.g., wires corresponding to the coupling determination pin, the communication pin, the audio channel signal transmission pin, the ground pin, and the plus battery pin).

The power management unit 190 may charge the battery 195 under the control of the processor 110. The power management unit 190 may identify a level of the battery 195 under the control of the processor 110. The processor 110 may periodically send a request for identification of a level of the battery 295 of the slave electronic device 200, to the slave electronic device 200. The processor 210 of the slave electronic device 200 may transmit the level of the battery 295 to the master electronic device 200 periodically or according to a request of the master electronic device 100.

In response to a battery level being insufficient in all of the pair of electronic device 100' or one electronic device (e.g., 100) among the pair of electronic device 100', the processor 110 may receive a current through the connector 170 via each of the sixth wire and the seventh wire within the cable 51 including the external battery 55, under the control of the processor 110, respectively. The current received through the connector 170 may charge the battery 195 by the processor 110 and the power management unit 190.

While the battery 195 is charged, audio data corresponding to one channel among stereo audio data may be forwarded from the master electronic device 100 to the slave electronic device 200 of which the battery 295 is being charged, through one of the third wire corresponding to the right-out (Rout) within the cable 51 and the fourth wire corresponding to the left-out (Lout). For example, in response to an electronic device being the master electronic device 100 of which the battery 195 is being charged, audio data corresponding to one channel among stereo audio data may be forwarded to the slave electronic device 200 of which the battery 295 is being charged through the third wire corresponding to the right-out (Rout) in the cable 51 coupled to the connector 170. In response to the electronic device being the master electronic device 200 of which the battery 295 is being charged, audio data corresponding to one channel among stereo audio data may be forwarded to the slave electronic device 100 of which the battery 195 is being charged, through the fourth wire corresponding to the left-out (Lout) in the cable 51 coupled to the connector 170.

The external battery 55 coupled to the cable 51 may charge the pair of electronic devices 100' at various times. The indicator 55*a* may be positioned on a surface of the external battery 55. The indicator 55*a* may flicker, or change a color according to a state (e.g., charging, level shortage, discharging, etc.) of the external battery 55. The number of the indicators 55*a* may be single or plural.

The external battery 55 coupled to the cable 51 may have a capacity capable of charging the pair of electronic devices 100' at many times. The capacity of the external battery 55 may be 200 milli amphere hour (mAh). The capacity of the external battery 55 may be 1,000 mAh. The capacity of the external battery 55 may be changed according to capacities of the batteries 195 and 295 of the pair of electronic devices 100'.

The constituent elements 210 to 295 of the slave electronic device 200 of FIG. 3 are substantially similar with the constituent elements 110 to 195 of the master electronic device 100 of FIG. 3 and thus, a duplicated description thereof is omitted.

In response to the electronic device 100 worn on the left ear among the pair of electronic devices 100' coupled with the cable 51 including the external battery 55 being a master electronic device, the electronic device 200 worn on the right ear may be a slave electronic device. Also, in response to the electronic device 200 worn on the right ear among the pair of electronic devices 100' coupled with the cable 51 including the external battery 55 being a master electronic device, the electronic device 100 worn on the left ear may be a slave electronic device.

The batteries 195 and 295 of the pair of electronic devices 100' mutually coupled by means of the cable 51 including the external battery 55 may be charged by a current supplied from the external battery 55, respectively.

Among the pair of electronic devices 100' mutually coupled by means of the cable 51 including the external battery 55, the master electronic device may transmit (or output) audio data corresponding to one channel among stereo audio data received from the external (or stored in the storage unit), to the slave electronic device through the cable 51. Among the pair of electronic devices 100', the master electronic device may transmit (or output) the audio data corresponding to the one channel among the received (or stored) stereo audio data, to the slave electronic device through one of the Lout and the Rout of the cable 51 including the external battery 55.

It may be easily understood by a person having ordinary skill in the art that at least one of the constituent elements of the pair of electronic devices 100' illustrated in FIG. 1A to FIG. 3 may be added (e.g., touch screen or touch pad adding), deleted (e.g., the indicator, etc.) or modified corresponding to the performance of the pair of electronic devices 100'.

An electronic device according to an embodiment of the disclosure includes a wireless interface, a wired interface, an audio output unit outputting audio data corresponding to one audio channel among audio data divided into a plurality of audio channels, and a processor controlling the wireless interface, the wired interface and the audio output unit. The processor is set to identify a given signal by using the wired interface and, in response to the given signal being obtained, transmit audio data corresponding to another audio channel among the plurality of audio channels to another electronic device that is coupled using the wired interface.

According to an aspect of the disclosure, the processor is set to, in response to being coupled with another electronic device by using the wireless interface, transmit the audio data corresponding to the another audio channel to another electronic device by using the wireless interface.

According to an aspect of the disclosure, the electronic device may further include a power management unit, and the processor may be set to provide the power management unit with power that is inputted through the wired interface by using the power management unit.

According to an aspect of the disclosure, the wireless interface may receive audio data corresponding to the plurality of audio channels from an external device.

An electronic device according to another embodiment of the disclosure includes a connector, an audio output unit, and a processor controlling the connector and the audio output unit, and the processor configured to output audio data corresponding to one channel among stereo audio data through the audio output unit based on determination that the connector is coupled with a cable to another electronic device, and transmit audio data corresponding to another channel among the stereo audio data to the another electronic device through the cable when the cable couples the connector to the another electronic device.

According to an aspect of the disclosure, the electronic device may be a master electronic device that operates in a master mode among master/slave modes, and the another electronic device may be a slave electronic device that is in a sleep state of operating in a slave mode among the master/slave modes.

According to an aspect of the disclosure, the processor may determine that the connector and the cable are coupled through a cable coupling determination pin.

According to an aspect of the disclosure, the processor may determine that the cable and the another electronic device are coupled through a communication pin of the cable.

According to an aspect of the disclosure, the electronic device may further include a communication unit, and the processor may control to receive the stereo audio data from the external through the communication unit.

According to an aspect of the disclosure, the electronic device may further include a storage unit, and the storage unit may store the stereo audio data.

According to an aspect of the disclosure, the electronic device and another electronic device may include at least one of a headphone, headset or earphone which outputs an audio to both ears of a user.

According to an aspect of the disclosure, the cable may include at least one of a part of a universal serial bus (USB) cable and implementing by a part of a 3.5 mm stereo audio cable.

According to an aspect of the disclosure, the cable may include a cable including a battery and a cable not including a battery.

According to an aspect of the disclosure, the cable including the battery may charge each of an internal battery of the electronic device and an internal battery of another storage device.

According to an aspect of the disclosure, the number of pins of the cable including the battery and the number of pins of the cable not including the battery may be different from each other.

According to an aspect of the disclosure, a current consumption amount of an internal battery of the electronic device may be greater than a current consumption amount of an internal battery of another electronic device within a given range.

According to an aspect of the disclosure, the processor may periodically check a level of an internal battery of the master electronic device through the power management unit, and in response to the level of the internal battery of the master electronic device being less than a battery setting value, the processor may control to change the master electronic device into a slave electronic device in the master/slave modes.

Figure 4:
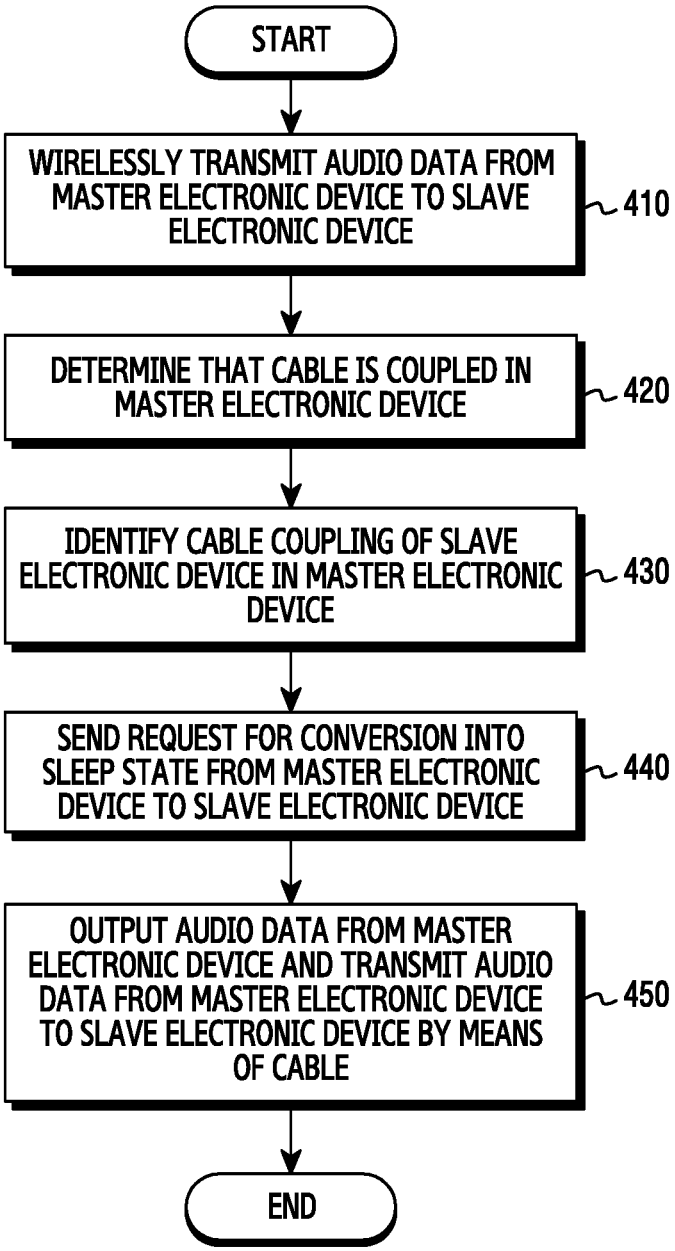
FIG. 4 is a schematic flowchart illustrating a current consumption control method of an electronic device according to an embodiment of the disclosure.

FIG. 4 is a schematic flowchart illustrating a current consumption control method of an electronic device according to an embodiment of the disclosure.

In operation 410 of FIG. 4, audio data is wirelessly transmitted from a master electronic device to a slave electronic device.

The master electronic device (e.g., a master earbud or the first electronic device 100) may receive stereo audio data (or multi-channel audio data of a 2.0 channel or more) from the external device 1 through the communication unit 120 under the control of the processor 110. Among the received stereo audio data (or the multi-channel audio data of the 2.0 channel or more), audio data corresponding to one channel may be outputted (or played) through the audio output unit 160 under the control of the processor 110 of the master electronic device 100.

Among the received stereo audio data (or the multi-channel audio data of the 2.0 channel or more), audio data corresponding to another channel may be wirelessly transmitted to the slave electronic device (e.g., a slave earbud or the second electronic device 200) through the communication unit 120 under the control of the processor 110 of the master electronic device 100. Among the received stereo audio data (or the multi-channel audio data of the 2.0 channel or more), the audio data corresponding to another channel may be outputted (or played) through the audio output unit 260 under the control of the processor 210 of the slave electronic device 200.

Among stereo audio data (or multi-channel audio data of a 2.0 channel or more) stored in the storage unit 180 of the master electronic device (or the master earbud 100), audio data corresponding to one channel may be outputted (or played) through the audio output unit 160. Among the stored stereo audio data (or the multi-channel audio data of the 2.0 channel or more), audio data corresponding to another channel may be wirelessly transmitted to the slave electronic device 200 through the communication unit 120 under the control of the processor 110 of the master electronic device 100. Among the received stereo audio data (or the multi-channel audio data of the 2.0 channel or more), the audio data corresponding to another channel may be outputted (or played) through the audio output unit 260 under the control of the processor 210 of the slave electronic device 200.

In operation 420 of FIG. 4, that the cable is coupled in the master electronic device is determined. In other embodiment, whether the cable is coupled in the master electronic device is determined.

The cable 50 is coupled to the master electronic device 100 and the slave electronic device 200. One side (e.g., connectors or plugs) of the cable 50 are coupled to the connector 170 of the master electronic device 100 and the connector 270 of the slave electronic device 200, respectively.

In response to the cable 50 being coupled to the connector 170 of the master electronic device 100, the processor 110 may identify the coupling of the slave electronic device 200 through the cable 50. In response to one side of the cable 50 being coupled to the connector 270 of the slave electronic device 200, the processor 210 may identify the coupling of the master electronic device 100 through the cable 50.

In response to one side of the cable 50 being coupled to the connector 170 of the master electronic device 100, the processor 110 may determine that the connector 170 is coupled to the cable 50 by using a cable coupling determination pin (e.g., by a recognition that a ground pin is low state when the cable coupling determination pin is coupled, and the electronic devices 100 and 200 are pull-up state, or by a wireless communication) In response to one side of the cable 50 being coupled to the connector 270 of the slave electronic device 200, the processor 210 may determine that the connector 270 and the cable 50 are coupled by using a cable coupling determination pin. According to various embodiments, the master electronic device 100 and the slave electronic device 200 may mutually determine that the two devices are electrically coupled through the connectors 170 and 270.

Similarly with the aforementioned coupling of the cable 50, in response to the cable 51 including the external battery 55 being coupled to the connector 170 of the master electronic device 100, the processor 110 may determine that the slave electronic device 200 is coupled through the cable 51 including the external battery 55. In response to the cable 51 including the external battery 55 being coupled to the connector 170 of the master electronic device 100, the processor 110 may identify the coupling of the external battery 55 through the cable 51 including the external battery 55.

Similarly with the aforementioned coupling of the cable 50, in response to one side of the cable 51 including the external battery 55 being coupled to the connector 170 of the master electronic device 100, the processor 110 may determine that the connector 170 and the cable 51 including the external battery 55 are coupled by using the cable coupling determination pin.

Similarly with the aforementioned coupling of the cable 50, in response to the cable 51 including the external battery 55 being coupled to the connector 270 of the slave electronic device 200, the processor 210 may determine that the master electronic device 100 is coupled through the cable 51 including the external battery 55. In response to the cable 51 including the external battery 55 being coupled to the connector 270 of the slave electronic device 200, the processor 210 may identify the coupling of the external battery 55 through the cable 51 including the external battery 55.

Similarly with the aforementioned coupling of the cable 50, in response to one side of the cable 51 being coupled to the connector 270 of the slave electronic device 200, the processor 210 may obtain the coupling of the connector 270 and the cable 51 including the external battery 55 by using the cable coupling determination pin.

The storage unit 180 may store cable coupling information (e.g., including a cable identifier (ID), a coupling time, slave coupling or non-coupling, or the like) of the master electronic device 100 corresponding to the coupling of the cables 50 and 51 under the control of the processor 110.

In operation 430 of FIG. 4, cable coupling of the slave electronic device is identified in the master electronic device.

In response to the coupling of the cable 50 being obtained in the master electronic device 100, the coupling of the cable 50 may be obtained in the slave electronic device 200 (e.g., by a recognition that a ground pin is low state when the cable coupling determination pin is coupled, and the electronic devices 100 and 200 are pull-up state, or by a wireless communication). The coupling of the master electronic device 100 with the cable 50 and the coupling of the slave electronic device 200 may be mutually obtained in each of the slave electronic device 200 and the master electronic device 100. A control command (or control signal) corresponding to the coupling of the cable 50 may be transmitted from the slave electronic device 200 to the master electronic device 100 through a communication pin of the cable 50. Also, the control command (or control signal) corresponding to the coupling of the cable 50 may be transmitted from the slave electronic device 200 to the communication unit 120 of the master electronic device 100 through the communication unit 220 as well.

The processor 110 of the master electronic device 100 may identify the cable 50 coupling of the slave electronic device 200 by using the received control command (or control information). The aforementioned obtaining of the cable coupling of the slave electronic device 200 in the master electronic device 100 is similar with the obtaining of the cable coupling of the master electronic device 100 in the slave electronic device 200 and thus, a duplicated description thereof is omitted.

Similarly with the aforementioned coupling of the cable 50, in response to the coupling of the cable 51 including the external battery 55 being obtained in the master electronic device 100, the coupling of the cable 51 including the external battery 55 may be obtained in the slave electronic device 200. A control command (or control signal) corresponding to the coupling of the cable 51 including the battery 55 may be transmitted from the slave electronic device 200 to the master electronic device 100 through a communication pin of the cable 51 including the battery 55. Also, the control command (or control signal) corresponding to the coupling of the cable 51 including the battery 55 may be transmitted from the slave electronic device 200 to the communication unit 120 of the master electronic device 100 through the communication unit 220.

The storage unit 180 may store cable coupling information (e.g., including a cable identifier (ID), a coupling time or the like) of the slave electronic device 200 corresponding to the coupling of the cables 50 and 51 under the control of the processor 110. According to various embodiments, the storage unit 180 may store related information for identifying information (i.e., device ID and configuration information) of the slave electronic device 200 received through the cable 50. Even the storage unit 280 of the slave electronic device 200 may store cable coupling information (e.g., including a cable identifier (ID), a coupling time or the like) of the master electronic device 100 corresponding to the coupling of the cables 50 and 51 under the control of the processor 210. Also, the storage unit 280 may store related information of the master electronic device 100.

In operation 440 of FIG. 4, a request for a change (or conversion) to a sleep state is made from the master electronic device to the slave electronic device.

According to the obtaining of the coupling of the connector 170 and the cable 50 in the master electronic device 100 and the identifying of the coupling of the connector 270 and the cable 50 in the slave electronic device 200, the processor 110 of the master electronic device 100 sends a request for a change (or conversion) into a sleep state excepting some constituent elements (or some units) of the slave electronic device 200.

The sleep state may signify a state in which only some constituent elements (e.g., an audio output unit, etc.) operate in the slave electronic device 200. The sleep state may signify a state in which some constituent elements do not operate in the slave electronic device 200. The sleep state may signify a state in which the constituent elements operating in the slave electronic device 200 are less than the constituent elements operating in the master electronic device 100 as well.

In accordance with the request of the master electronic device 100, the slave electronic device 200 may change (or convert) into the sleep state. The slave electronic device 200 changing (or converting) into the sleep state may decrease a current consumption amount compared with a working state (e.g., being changeable equal to or less than a range of about 25% compared to the working state). The aforementioned decrease of the current consumption amount may be a range of about 30% or less to a range of about 15% or more compared to the working state. The aforementioned decrease of the current consumption amount may be a range of about 35% or less to a range of about 1% or more compared to the working state as well. The slave electronic device 200 changing (or converting) into the sleep state may wake up from the sleep state by a wakeup command (e.g., reception of a control command from the master electronic device 100, occurrence of an interrupt within the slave electronic device 200, or the like).

The excepted some constituent elements may be, for example, constituent elements (e.g., a part of the processor 110, a codec (not shown), the battery 195, etc.) corresponding to reception and/or playing of audio data corresponding to another channel among stereo audio data (or multichannel audio data of a 2.0 channel or more) transmitted from the master electronic device 100. Also, the remaining constituent elements may include the communication unit, the battery, etc., for example.

Referring back to FIG. 1A, current consumption amounts of the master electronic device 100 and the slave electronic device 200 that are in the working state may be different respectively. The master electronic device 100 may consume a current corresponding to the receiving of stereo audio data from the external device 1 through the communication unit 120, the outputting of audio data corresponding to one channel among the stereo audio data through the audio output unit 160, and the transmitting of audio data corresponding to another channel among the stereo audio data to the slave electronic device 200 through the communication unit 120. The slave electronic device 200 may consume a current corresponding to the receiving of audio data corresponding to another channel among the stereo audio data from the master electronic device 100 through the communication unit 120 and the outputting of audio data corresponding to another channel among the stereo audio data through the audio output unit 260. For example, the current consumption amount of the master electronic device 100 that is in the working state may be greater than the current consumption amount of the slave electronic device 200 that is in the working state. The aforementioned comparison of the current consumption amount is one embodiment, and may be changed according to functions and/or operations of the master electronic device and the slave electronic device.

The slave electronic device 200 changing (or converting) into the sleep state according to the request of the master electronic device 100 may return a response corresponding to the sleep state change (or conversion) through communication pins of the cables 50 and 51.

In an operation 450 of FIG. 4, the audio data is outputted in the master electronic device, and the audio data is transmitted from the master electronic device to the slave electronic device by means of a cable.

In response to the request for the change (or conversion) to the sleep state from the master electronic device 100 to the slave electronic device 200 being made, the master electronic device 100 outputs audio data corresponding to one channel among stereo audio data (or multi-channel audio data of a 2.0 channel or more) through the audio output unit 160. The master electronic device 100 may transmit (or output) audio data corresponding to another channel among the stereo audio data (or the multi-channel audio data of the 2.0 channel or more) to the slave electronic device 200 through the cables 50 and 51 during a given period of time (e.g., continuously).

In response to a response corresponding to the sleep state change (or conversion) being received from the slave electronic device 200, the master electronic device 100 outputs audio data corresponding to one channel among the stereo audio data (or the multi-channel audio data of the 2.0 channel or more) through the audio output unit 160 by using a switch (not shown). The master electronic device 100 may transmit (or output) audio data corresponding to another channel among the stereo audio data (or the multi-channel audio data of the 2.0 channel or more) to the slave electronic device 200 through the cables 50 and 51 during a given period of time (e.g., continuously) by using the switch (not shown).

The slave electronic device 200 being in the sleep state may output the audio data (e.g., audio data corresponding to any one channel among multi-channel audio data), which is received from the master electronic device 100 by using the cables 50 and 51, through the audio output unit 260 during a given period of time (e.g., continuously) by using the switch (not shown).

The audio data corresponding to another channel among the received stereo audio data (or the multi-channel audio data of the 2.0 channel or more) may be directly outputted through the audio output unit 260.

In various embodiments, the slave electronic device 200 being in the sleep state may forward the audio data, which is received from the master electronic device 100 being in an active state (e.g., a state not being the sleep state) through the cable 50 or 51, to the audio output unit 260 by using a signal line 271 without going through the processor 210 (e.g., directly), and the audio output unit 260 may process the forwarded audio data and output the processed audio data. In the aforementioned embodiment, by outputting the audio data by using the audio output unit 260 without going through the processor 210, the slave electronic device 200 may improve a power consumption rate of the slave electronic device 200. In various embodiments, in response to the master electronic device 100 being switched to a sleep mode and the slave electronic device 200 being switched to an active mode, the master electronic device 100 may forward audio data, which is received from the slave electronic device 200 by using the slave cable 50 or 51, to the audio output unit 160 by using a signal line 171 without going through the processor 110.

A current consumption amount of the slave electronic device 200 being in the sleep state may be less than a current consumption amount of the slave electronic device 200 being in the working state. A total current consumption amount of the master electronic device 100 being in the working state and the slave electronic device 200 being in the sleep state may be less than a total current consumption amount of the master electronic device 100 being in the working state and the slave electronic device 200 being in the working state. By forwarding the audio data to the slave electronic device 200 through the cables 50 and 51, a current consumption amount of the slave electronic device 200 may be decreased.

In response to considering the total current consumption amount of the master electronic device 100 being in the working state and the slave electronic device 200 being in the sleep state, the operation time of the master electronic device and the slave electronic device may be each increased.

During operation 450 of FIG. 4, the master electronic device and/or the slave electronic device may return to operations 410 to 440 of FIG. 4.

In response to the audio data being outputted in the master electronic device and the audio data being transmitted from the master electronic device to the slave electronic device by means of the cable in operation 450 of FIG. 4, the current consumption control method of the electronic device is terminated.

Figure 5:
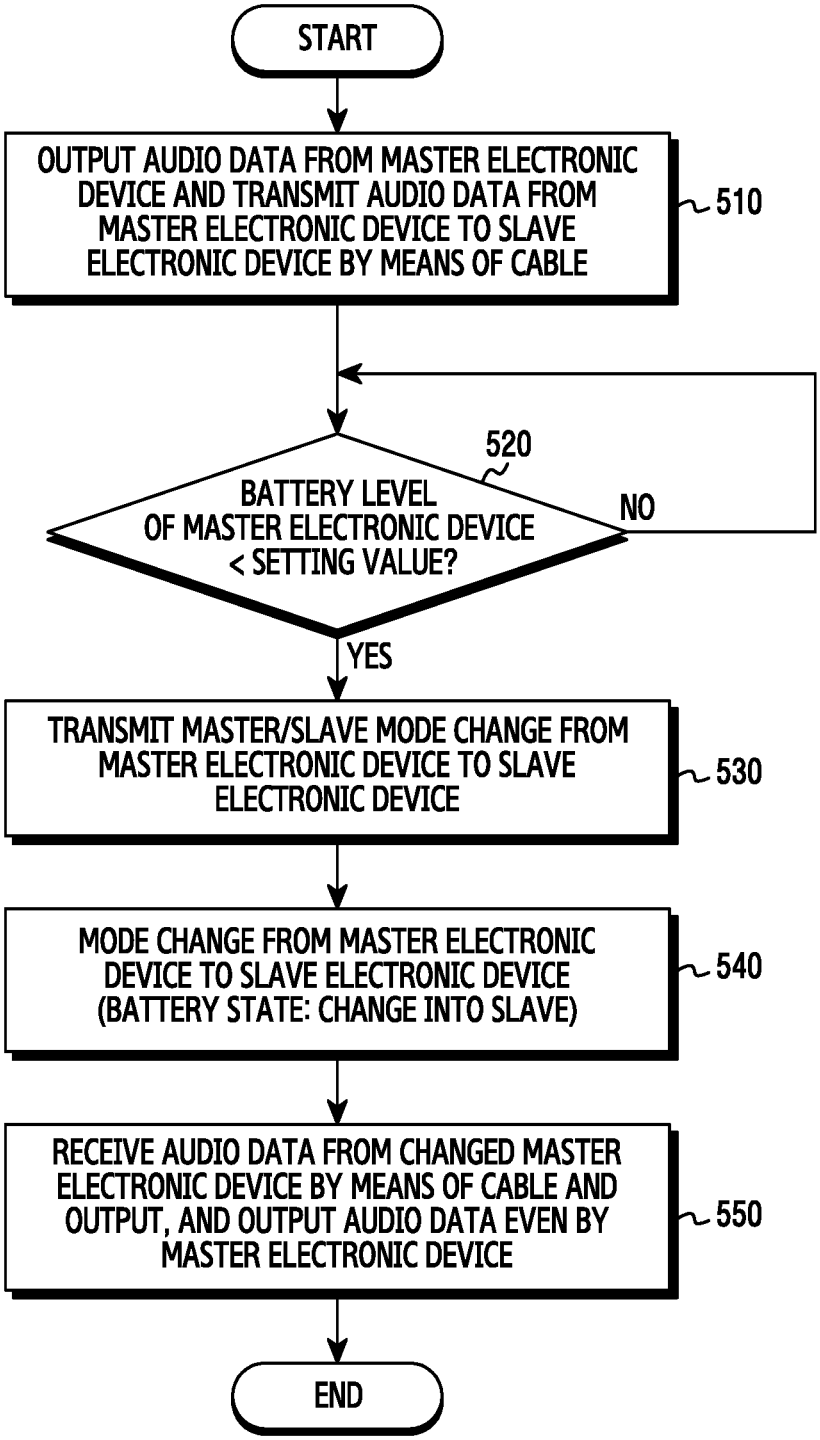
FIG. 5 is a schematic flowchart illustrating a current consumption control method of an electronic device according to another embodiment of the disclosure.

FIG. 5 is a schematic flowchart illustrating a current consumption control method of an electronic device according to another embodiment of the disclosure.

In operation 510 of FIG. 5, audio data is outputted in a master electronic device, and the audio data is transmitted from the master electronic device to a slave electronic device by means of a cable. The processor 110 of the master electronic device 100 may periodically check a level of the battery 195 through the power management unit 190. The processor 110 may exchange battery information between the master electronic device and the slave electronic device.

The master electronic device 100 outputs audio data corresponding to one channel among stereo audio data (or multi-channel audio data of a 2.0 channel or more) through the audio output unit 160 by using a switch (not shown). The master electronic device 100 may transmit (or output) audio data corresponding to another channel among the stereo audio data (or the multi-channel audio data of the 2.0 channel or more) to the slave electronic device 200 through the cables 50 and 51 by using the switch (not shown).

The master electronic device 100 being in a working state and the slave electronic device 200 being in a sleep state each consume a battery current. A current consumption amount of the master electronic device 100 being in the working state may be greater than a current consumption amount of the slave electronic device 200 being in the sleep state.

A current consumption amount of the master electronic device 100 being in the working state may be the majority (e.g., about 70% or more of the whole, and % being changeable) of a total current consumption amount of the master electronic device 100 being in the working state and the slave electronic device 200 being in the sleep state. The majority of the current consumption amount of the master electronic device 100 being in the working state among the aforementioned total current consumption amount is one example, and about 51% or more of the total current consumption amount is sufficient. 'The majority of the current consumption amount of the master electronic device 100 being in the working state among the aforementioned total current consumption amount' may be called a given range.

In response to the battery 195 level of the master electronic device 100 being continuously in the working state being insufficient, there may be a need to change (or convert, swap) the slave electronic device 200 having the battery 295 having more sufficient level than that of the master electronic device 100, into a master electronic device. In response to the slave electronic device 200 having the sufficient battery level being changed (or converted) into the master electronic device, there may be a need to change (or convert) the existing master electronic device 100 having the insufficient battery level, into a slave electronic device.

In operation 520 of FIG. 5, a battery level of the master electronic device is compared with a setting value.

The processor 110 of the master electronic device 100 may periodically check the level of the battery 195 through the power management unit 190. The processor 110 of the master electronic device 100 may periodically check the level of the battery 195 and a battery setting value stored in the storage unit 180 (e.g., about 10% or less of a total battery level, and % being changeable) through the power management unit 190. Also, the processor 110 of the master electronic device 100 may periodically receive battery level information corresponding to a battery level from the slave electronic device 200 through the cables 50 and 51.

The storage unit 180 may store a level of the battery 195 of the master electronic device 100, a battery setting value, and/or a level of the battery 295 of the slave electronic device 200, under the control of the processor 110.

In response to the battery level of the master electronic device being less than the battery setting value, it goes to operation 530 of FIG. 5. In response to the battery level of the master electronic device being greater than the battery setting value, it returns to before operation 520 of FIG. 5.

According to various embodiments, the battery setting value may be changed according to the received battery information of the slave electronic device.

In operation 530 of FIG. 5, a request for a master/slave mode change is made from the master electronic device to the slave electronic device.

In response to the battery level of the master electronic device being less than the battery setting value, the processor 110 of the master electronic device 100 may send a request for a control command corresponding to the master/slave mode change to the slave electronic device 200 through the cables 50 and 51. Also, for continuous operation (e.g., audio playback, etc.), the processor 110 of the master electronic device 100 may send a request for a control command corresponding to the master/slave mode change to the slave electronic device 200 through the cables 50 and 51.

The processor 210 of the slave electronic device 200 may check a level of the battery 295 according to reception of the control command corresponding to the master/slave mode change request. The processor 210 of the slave electronic device 200 may compare the level of the battery 295 and the battery setting value (e.g., about 10% or less of a total battery level, and % being changeable).

In response to the level of the battery 295 being greater than the battery setting value, the processor 210 of the slave electronic device 200 may transmit a response corresponding to master/slave mode change acceptance to the master electronic device 100 through the cables 50 and 51. In response to the processor 210 of the slave electronic device 200 transmitting the response corresponding to the master/slave mode change acceptance to the master electronic device 100 through the cables 50 and 51, the processor 210 of the slave electronic device 200 may change (or convert) into a master mode among master/slave modes. In response to the slave electronic device 200 being changed (or converted) into the master mode, even a mode of the battery 295 may be changed (or converted) into the master mode.

In response to the slave electronic device 200 being changed (or converted) into the master mode, the processor 210 of the changed (or converted) master electronic device 200 may receive stereo audio data from the external device 1 through the communication unit 220.

In response to the level of the battery 295 being less than the battery setting value, the processor 210 of the slave electronic device 200 may transmit a response corresponding to master/slave mode change impossibility to the master electronic device 100 through the cables 50 and 51 as well.

In operation 540 of FIG. 5, a change (or conversion) is made from the master electronic device to the slave electronic device. The master electronic device may be changed into the slave electronic device according to a battery state.

In response to the master electronic device 100 receiving a response corresponding to master/slave mode change acceptance from the existing (or before change (or conversion)) slave electronic device 200 through the cables 50 and 51, the processor 110 of the master electronic device 100 may change (or convert) into a slave mode among the master/slave modes.

In response to the master electronic device 100 being changed (or converted) into the slave mode, the processor 110 may stop (or pause) outputting of audio data and transmitting of the audio data. In response to the master electronic device 100 being changed (or converted) into the slave mode, the processor 110 may stop (or pause) receiving of the audio data through the communication unit 120. In response to the master electronic device 100 being changed (or converted) into the slave mode, even a mode of the battery 195 may be changed (or converted) into the slave mode.

The storage unit 180 may store a slave mode change (or conversion) of the master electronic device 100 and/or a battery mode change (or conversion) (e.g., a change (or conversion) into the slave mode) under the control of the processor 110.

In operation 550 of FIG. 5, audio data is received from the changed master electronic device by means of the cable and is outputted, and the audio data is outputted even from the changed master electronic device.

The changed slave electronic device 100 may receive audio data corresponding to another channel among stereo audio data (or multi-channel audio data of a 2.0 channel or more) from the changed master electronic device 200 through the cables 50 and 51. The audio data corresponding to another channel among the stereo audio data (or the multi-channel audio data of the 2.0 channel or more) received from the changed master electronic device 200 is outputted through the audio output unit 160 by using a switch (not shown).

In response to the change of the master electronic device into the slave electronic device, wires of the cables 50 and 51 that are transmission paths of audio data may be changed (e.g., the third wire may be changed into the forth wire by the switch (not shown)).

The changed master electronic device 200 may output audio data corresponding to one channel among stereo audio data (or multi-channel audio data of a 2.0 channel or more) through the audio output unit 260 by using a switch (not shown).

In response to the audio data being received from the changed master electronic device by means of the cable and being outputted, and the audio data being outputted even from the changed master electronic device in operation 550 of FIG. 5, the current consumption control method of the electronic device is terminated.

A current consumption control method of an electronic device according to an embodiment of the disclosure includes outputting audio data corresponding to one channel among stereo audio data from a master electronic device through an audio output unit, and wirelessly transmitting audio data corresponding to another channel among the stereo audio data from the master electronic device to a slave electronic device, determine that the cable is coupled with the connector of the master electronic device, sending a request for a change of the slave electronic device into a sleep state through the cable, based at least on determination that the cable is coupled with the connector, and transmitting the audio data corresponding to another channel among the stereo audio data, to the slave electronic device changed into the sleep state through the cable during a given period of time, and the cable includes a cable including a battery and a cable not including a battery.

According to an aspect of the disclosure, the method may further include, in response to a level of at least one battery among an internal battery of the master electronic device and an internal battery of the slave electronic device being insufficient, coupling with the cable including the battery, and charging the at least one battery among the internal battery of the master electronic device and the internal battery of the slave electronic device.

Methods according to an embodiment of the disclosure may be implemented in the form of a program command capable of being performed through various computer means, and be recorded in a computer-readable medium. The computer-readable medium may include a program command, a data file, a data structure, etc. singularly or in combination. For example, the computer-readable medium may be stored in a volatile or nonvolatile storage device such as a storage device of a ROM, etc., or, for example, a memory such as a RAM, a memory chip or device or an integrated circuit, or, for example, a storage medium which is optically or magnetically recordable such as a CD, a DVD, a magnetic disk, a magnetic tape or the like and simultaneously is readable by a machine (e.g., a computer) irrespective of erasability or rewritability.

A computer-readable program may be stored in a computer-readable storage medium of a server, and the computer program may be downloaded to a computing device through a network.

It will be able to be appreciated that a memory capable of being included in a portable device is an example of a storage medium which is readable by a program including instructions implementing embodiments of the disclosure or a machine suitable for storing the programs. A program command recorded in the medium may be particularly designed and configured for the invention or may be known to and usable by those skilled in the computer software art as well.

As above, the disclosure has been described by the aforementioned embodiment and drawing, but the disclosure is not limited to the above embodiment, and various modifications and changes are possible from this disclosure by a person having ordinary skill in the art.

Therefore, the scope of the disclosure should not be limited and defined to the described embodiment, and should be defined by not only claims described later but also equivalents to these claims.

According to embodiments of the disclosure, an electronic device and a current consumption control method of the electronic device coupling a master electronic device and a slave electronic device by means of a cable, to decrease current consumption amounts of the master electronic device and the slave electronic device and increase an operation time may be provided.

According to embodiments of the disclosure, an electronic device and a current consumption control method of the electronic device coupling a master electronic device and a slave electronic device by means of a cable, to decrease a current consumption amount of one of the master electronic device and the slave electronic device and increase an operation time may be provided.

The embodiments disclosed in the specification and drawings are merely presented to easily describe the technical contents of the present disclosure and help with the understanding of the present disclosure and are not intended to limit the scope of the present disclosure. Therefore, all changes or modifications derived from the technical idea of the present disclosure as well as the embodiments described herein should be interpreted to belong to the scope of the present disclosure.

What is claimed is:

1. An electronic device comprising:
a wireless interface;
a wired interface;
an audio output unit configured to output audio data corresponding to one audio channel among audio data divided into a plurality of audio channels; and
a processor electrically coupled to the wireless interface, the wired interface and the audio output unit, wherein the processor is configured to:
identify a given signal by using the wired interface, and
in response to the given signal being obtained, transmit audio data corresponding to another audio channel among the plurality of audio channels to another electronic device that is coupled using the wired interface.

2. The electronic device of claim 1, wherein the processor is set to, in response to being coupled with another electronic device by using the wireless interface, transmit the audio data corresponding to the another audio channel to another electronic device by using the wireless interface.

3. The electronic device of claim 1, further comprising a power management unit, and wherein the processor is set to provide the power management unit with power that is inputted through the wired interface.

4. The electronic device of claim 1, wherein the wireless interface receives audio data corresponding to the plurality of audio channels from an external device.

5. An electronic device comprising:
a connector;
an audio output unit; and
a processor electrically coupled to the connector and the audio output unit, wherein the processor is configured to:
output audio data corresponding to one channel among stereo audio data through the audio output unit based on determination that the connector and a cable are coupled, and
transmit audio data corresponding to another channel among the stereo audio data to another electronic device through the cable.

6. The electronic device of claim 5, wherein the electronic device is a master electronic device that operates in a master mode among master/slave modes, and another electronic device is a slave electronic device that is in a sleep state of operating in a slave mode among the master/slave modes.

7. The electronic device of claim 6, wherein the processor periodically checks a level of an internal battery of the master electronic device through a power management unit, and in response to the level of the internal battery of the master electronic device being less than a battery setting value, the processor controls to change the master electronic device into a slave electronic device in the master/slave modes.

8. The electronic device of claim 6, wherein the processor periodically checks a level of an internal battery of the master electronic device through the power management unit, and in response to the level of the internal battery of the master electronic device being less than a battery setting value, the processor controls to send a request for a change into a master electronic device to the slave electronic device in the master/slave modes.

9. The electronic device of claim 5, wherein the processor is configured to determine that the connector and the cable are coupled through a cable coupling determination pin.

10. The electronic device of claim 5, wherein the processor is configured to determine that the cable and the another electronic device are coupled through a communication pin of the cable.

11. The electronic device of claim 5, further comprising a communication unit, and wherein the processor is further configured to receive the stereo audio data from an external electronic device through the communication unit.

12. The electronic device of claim 5, further comprising a storage unit, and wherein the storage unit stores the stereo audio data.

13. The electronic device of claim 5, wherein the electronic device and the another electronic device comprise at least one of a headphone, headset or earphone which is configured to output audio data to both ears of a user.

14. The electronic device of claim 5, wherein the cable comprises at least one of a part of a universal serial bus (USB) cable and a part of a 3.5 mm stereo audio cable.

15. The electronic device of claim 5, wherein the cable comprises a cable comprising a battery and a cable not comprising a battery.

16. The electronic device of claim 15, wherein the cable comprising the battery charges each of an internal battery of the electronic device and an internal battery of another storage device.

17. The electronic device of claim 15, wherein the number of pins of the cable comprising the battery and the number of pins of the cable not comprising the battery are different from each other.

18. The electronic device of claim 5, wherein a current consumption amount of an internal battery of the electronic device is greater than a current consumption amount of an internal battery of another electronic device within a given range, and the given range comprises a current consumption amount of the electronic device being operating among a total current consumption amount.

19. A current consumption control method of an electronic device, comprising:

outputting audio data corresponding to one channel among stereo audio data from a master electronic device through an audio output unit, and wirelessly transmitting audio data corresponding to another channel among the stereo audio data from the master electronic device to a slave electronic device;

determining that a cable and a connector of the master electronic device are coupled;

sending a request for a change of the slave electronic device into a sleep state through the cable, based at least on the determination; and transmitting the audio data corresponding to another channel among the stereo audio data, to the slave electronic device changed into the sleep state through the cable during a given period of time, wherein the cable comprises a cable comprising a battery and a cable not comprising a battery.

20. The method of claim 19, further comprising, in response to a level of at least one battery among an internal battery of the master electronic device and an internal battery of the slave electronic device being insufficient, coupling with the cable comprising the battery, and charging the at least one battery among the internal battery of the master electronic device and the internal battery of the slave electronic device.

* * * * *